US005670726A

United States Patent [19]

Kolaska et al.

[11] Patent Number: 5,670,726

[45] Date of Patent: Sep. 23, 1997

[54] CERMET AND METHOD OF PRODUCING IT

[75] Inventors: Hans Kolaska, Bottrop; Klaus Dreyer, Essen, both of Germany

[73] Assignee: Widia GmbH, Essen, Germany

[21] Appl. No.: 507,442

[22] PCT Filed: Jan. 22, 1994

[86] PCT No.: PCT/DE94/00048

§ 371 Date: Sep. 1, 1995

§ 102(e) Date: Sep. 1, 1995

[87] PCT Pub. No.: WO94/21835

PCT Pub. Date: Sep. 29, 1994

[30] Foreign Application Priority Data

Mar. 23, 1993 [DE] Germany ..... 43 09 261.6
Dec. 24, 1993 [DE] Germany ..... 43 44 576.4

[51] Int. Cl.[6] ..... C22C 29/02; B22F 3/12

[52] U.S. Cl. ..... 75/237; 75/241; 75/242; 75/238; 419/15; 419/16; 419/18; 419/33; 419/38

[58] Field of Search ..... 75/238, 240, 241–242, 75/237; 419/15, 16, 18, 33, 38

[56] References Cited

U.S. PATENT DOCUMENTS

| | | | |
|---|---|---|---|
| 4,957,548 | 9/1990 | Shima et al. | 75/238 |
| 4,985,070 | 1/1991 | Kitamura et al. | 75/238 |
| 5,421,851 | 6/1995 | Oskarsson et al. | 75/238 |

FOREIGN PATENT DOCUMENTS

| | | |
|---|---|---|
| 0 270 509 B1 | 6/1988 | European Pat. Off. . |
| 0 302 635 A1 | 2/1989 | European Pat. Off. . |
| 0 374 358 A1 | 6/1990 | European Pat. Off. . |
| 0 406 201 A1 | 1/1991 | European Pat. Off. . |
| 0 417 333 A1 | 3/1991 | European Pat. Off. . |
| 0 495 101 A1 | 7/1992 | European Pat. Off. . |
| 34 18 403 C2 | 11/1984 | Germany . |
| 40 00 937 A1 | 7/1990 | Germany . |
| 85-042289 | 1/1985 | Japan . |

OTHER PUBLICATIONS

"Cermets Der Neuen Generation" by Ettmayer et al. published in Metallwissenschaft + Technik, Year 43, vol. 8, Aug. 1989.

*Primary Examiner*—Ngoclan Mai
*Attorney, Agent, or Firm*—Jonathan Myers; Herbert Dubno

[57] ABSTRACT

In order to improve the toughness characteristics of a cermet alloy, while retaining high resistance to wear, a composition is disclosed which contains 30 to 60% by weight of Ti, 5 to 20% by weight of W, 5 to 15% by weight of Ta, in which up to 70% of the Ta can be replaced by Nb, and 5 to 25% by weight of Ni and/or Co binder with more than 80 mole %, relative to the above transition elements of carbon and nitrogen. The composition is prepared by grinding, compressing and sintering a solid, powder-form mixture containing (Ti,W,Ta,Nb)C powder, Ti(C,N) powder, and WC powder, each powder having a particle size <1.5 μm, plus Ni powder and/or Co powder. The mixture includes the following ingredients: (a) (Ti,W,Ta,Nb)C with a mean particle size <1.5 μm, this mixed carbide containing 20 to 50% by weight of TiC, 20 to 40% by weight of WC, and 20 to 40% by weight of (Ta, Nb)C; (b) Ti(C,N), with a mean particle size <1.5 μm and an N/(C+N) ratio <0.7; WC with a mean particle size <1.5 μm; and (d) nickel and/or cobalt.

15 Claims, 3 Drawing Sheets

CERMET AND METHOD OF PRODUCING IT

FIELD OF THE INVENTION

The invention relates to a cermet with a hard material phase of 95 to 75% by mass, the balance being binders of cobalt and nickel. The invention relates further to method of producing such a cermet by grinding a carbide, nitride and/or carbonitride of titanium and tungsten and optionally further elements of the Groups IVa to VIa of the classification of elements, as well as a binder metal such as a cobalt and/or nickel containing mixture which is subsequently pressed and sintered.

BACKGROUND OF THE INVENTION

The JP-A-60002646 describes an alloy with a ternary hard material phase of WC, (Ti,W,Ta/Nb)C and (Ti,W,Ta/Nb)CN, whereby the alloy contains 5 to 15% by weight Co, 5 to 5% by weight (Ti,W)C, 50% by weight (Ti,W)CN, 1 to 15% by weight TaC, NbC and/or (Ta,Nb)C, the balance WC and impurities.

Cermets consisting of 25 to 50% by weight titanium nitride, 10 to 30% by weight titanium carbide, 5 to 25% by weight tantalum carbide, niobium carbide and/or zirconium carbide, 10 to 25% by weight tungsten carbide and 7.5 to 25% by weight binders of cobalt and/or nickel, as well as optionally 0.01 to 1% by weight aluminum added to the binder and also a process for the production of the cermet are known from DE 34 18 403 C2. In the mentioned process first a formed body is produced by preliminary compression from the powder mixture of the above composition and this formed body is sintered at over 1400° C. in a nitrogen atmosphere, at a pressure between 0.13 and 133 mbar.

In order to improve the toughness, U.S. Pat. No. 4,778,521 proposes a cermet composition consisting of 20 to 92% by weight titanium carbonitride, 5 to 50% by weight tungsten carbide and 3 to 30% by weight of a binder and has a triphase particle size microstructure comprising a core phase which is rich in titanium carbonitride, an intermediate phase rich in tungsten carbide surrounding the so-called core phase and an outer phase of titanium/tungsten carbonitride surrounding the previously mentioned intermediate phase. In order to produce this cermet, titanium carbide powder, tungsten carbide and nickel are mixed and further treated as shown above.

For improving the mechanical characteristics, and especially for improving the resistance against plastic deformation, the EP 0 270 509 $B_1$ proposes to heat a mixtures of powders of TiC and (Ta, Nb) C and/or TaC after they have been mixed, and to comminute into a powder the solid solution resulting after cooling. This powder should then be mixed with carbides and nitrides or carbonitrides of metals of the Groups IVa to VIa of the classification of elements, as well as with a binder, pressed and sintered. The thereby produced body has a carbonitride component as a biphase mixture with a phase poor in nitrogen but rich in titanium and tantalum and a second phase which is rich in metal components of Group VI and in nitrogen. The first phase forms the core and is surrounded by the second phase as a marginal zone, which at the same time forms the main border surface with the binder metal alloy.

Especially for chip-removal machining operations with high cutting speeds it is proposed to prepare at first a carbonitride mixture of the composition (Ti, Ta, W)(C, N) and to mix with a binder the carbonitride powder mixture obtained this way, to grind it and to compress it into a green compact and subsequently to sinter it under nitrogen.

However according to EP 0 302 635 A1 there are two phases, the first of which (the core phase) has a carbonitride which is poor in titanium and nitrogen, while the second phase surrounding the core consists of carbonitrides rich in titanium and nitrogen. This is supposed to be achieved for instance by mixing, compacting and sintering titanium nitride or titanium carbonitride with a carbonitride of tungsten or titanium and optionally with one or further elements of Groups IVa to VIa of the classification of elements.

According to EP 0 417 333 A1 for the production of a cermet alloy in the beginning a first powder for the formation of a core structure of carbides and carbonitrides containing titanium and a second powder for the formation of the marginal zone of titanium nitride, tantalum carbide and tungsten carbide, as well as a third powder of a binder metal, such as cobalt and nickel are prepared, and the entire mixture thereof is compacted and sintered.

The EP 0 406 201 A1 describes a carbonitride alloy with at least 80% by volume hard materials which form duplex structures of core zones and marginal zones and which constitute 10 to 80% by volume of the entire hard material phase. The carbonitride metals are selected from the Groups IVa and VIa of the classification of elements.

The DE 40 00 937 A1 describes a process for the production of cermet starting out from powdery titanium carbide to which, besides the binder, mixed carbides of the elements tantalum, niobium, tungsten, or tantalum and tungsten, or titanium, tantalum and tungsten are admixed. The titanium carbide can also be partially enriched with zirconium as a starting material.

OBJECT OF THE INVENTION

It is the object of the present invention to indicate a cermet compound as well as a process for its production, wherein the toughness as well as the wear resistance during machining are considerably improved when compared to the state of the art cermets.

SUMMARY OF THE INVENTION

The object of the invention is achieved by a cermet with a hard material phase containing (Ti,W,Ta/Nb)C, (Ti,W,Ta, /Nb)CN, the balance a binder phase with a proprtion of <5% by mass of Co and/or Ni, said cermet having a gross composition of 30 to 60% by mass Ti, 5 to 20% by W, 5 to 11% by mass Ta which can be replaced up to 70% by Nb, 5 to 25% by mass Ni and/or Co, with more than 80% mole relative to the abovementioned Ti, W, Ta, and/or Nb of carbon and nitrogen, and which has at least 40% of hard material particles in the stucture with a core-margin stucture with cores of Ti (C,N) N<C and homogenneous marginal zones of (Ti, W, Ta/Nb)C, whereby the proportion of the hard material phase amounts to 95 to 75% by mass.

As far as no unitary core-margin structure exists over the entire cermet body, 40 to 60% by volume of the hard material phase consists of particles with a core-margin structure with a core rich in nitrogen made of TiCN ($N/(N+C) \leqq 0.7$)) and a marginal zone made of (Ti, W, Ta and/or Nb)C with Ti=50 to 65% by mass, W=15 to 30% by mass, Ta and/or Nb=8 to 20% by mass and 60 to 40% by volume of the hard material phase consisting of particles with a homogeneous composition corresponding to the above-described marginal zone, whereby the proportion of binder phase ranges between 5 and 25% by mass.

Surprisingly it has been found that by following the afore-mentioned composition according to the invention, respectively the selection of the starting materials a much more fine-grained cermet alloy with improved toughness characteristics can be created. The structure formation is uniformly fine-grained and has essentially a cubic NaCl crystalline structure ($B_1$ structure) with an evenly distributed binder metal phase.

On account of the particles with a homogeneous composition, up to 5% by volume of the hard material particles have a core composition of (Ti, W, Ta and/or Nb)C with 43 to 53% by mass titanium, 35 to 50% by mass tungsten, 4 to 8% by mass tantalum and/or niobium, whereby the marginal zone corresponds with the above-mentioned composition. This means that the border surfaces of all hard material particles have the same aforedescribed composition with respect to the binder phase.

According to a further embodiment the hard material phase has exclusively a cubic $B_1$-crystalline structure and has an average core diameter of <1.5μ in conditions of even distribution of the binder metal phase.

Further the cermet alloy can contain additionally (in % by mass) 0 to 12 molybdenum, 0 to 5 vanadium, 0 to 5 chromium and/or 0 to 2 aluminum.

According to a further embodiment of the invention the binder is present in a proportion of Ni/(Ni+Co)=0.2 to 0.8. Furthermore the nitrogen is preferably selected in a proportion ranging between 0.2 and 0.8 in relation to the sum of carbon and nitrogen.

Further it is preferred that in the binder metal phase considerably larger amounts of tungsten than of titanium be dissolved, whereby the tungsten can be partially replaced by molybdenum, vanadium, chromium or aluminum.

The object of the invention relating to the process is achieved due to the steps taken in accordance with the present process whose novelty consists in the fact that the starting powder mixture has the following components:

(a) 15 to 45% by mass (Ti, W, Ta,)C with an average particle size of <1.5μ, whereby this carbide mixture contains 20 to 50% by mass TiC, 20 to 40% by mass WC and 20 to 40% by mass TaC, whereby up to 70% by mass of Ta can be replaced by Nb.

(b) 3 to 15% by mass WC with an average particle size <1.5μ, (c) 5 to 25% by mass of nickel and/or cobalt and (d) the balance Ti(C, N) with an average particle size of <1.5μ and N/(C+N)<0.7, preferably 25 to 65% by mass Ti(C,N).

This starting powder mixture, whose components a) and d) are prepared as master alloys, is ground, pressed into a green compact and sintered according to the known state of the art.

According to a further embodiment of the process according to the invention $TiAl_2C$, molybdenum and/or molybdenum carbide, chromium and/or chromium carbide and/or vanadium carbide can be included in the starting mixture up to 5% by mass.

Preferably the mixed carbide (W, Ti, Ta, Nb)C is selected with a grain size of 0.5μ and with the proportion of carbides WC:TiC:(Ta, Nb)C=1:1:1. Further the titanium carbide can be used in the starting substance with an average particle size of 1.2μ and in a proportion of N/(C+N)=0.75.

In a concrete embodiment example of the invention 29.6% by mass (W, Ti, Ta, Nb)C of an average grain size of approximately 0.5μ with equal parts of TiC, WC and (Ta, Nb)C (with Ta/(Ta+Nb)=0.9) and 43.4% Ti(C,N) with a grain size of approximately 1.2μ and a N/(N+C)=0.75 proportion of 9.3% by mass WC, 8.2% by mass Ni, 8.5% by mass Co and 1.0% by mass $TiAl_2C$ are mixed together, wet ground, compressed into a green compact and subsequently sintered or pressure-sintered to a cutting tool. The sintered material produced this way distinguishes itself over the cermet sintered materials known to the state of the art with a comparable gross composition by being considerably more fine-grained.

BRIEF DESCRIPTION OF THE DRAWING

The above and other objects, features, and advantages will become more readily apparent from the following description, reference being made to the accompanying drawing in which.

Figure 1A:
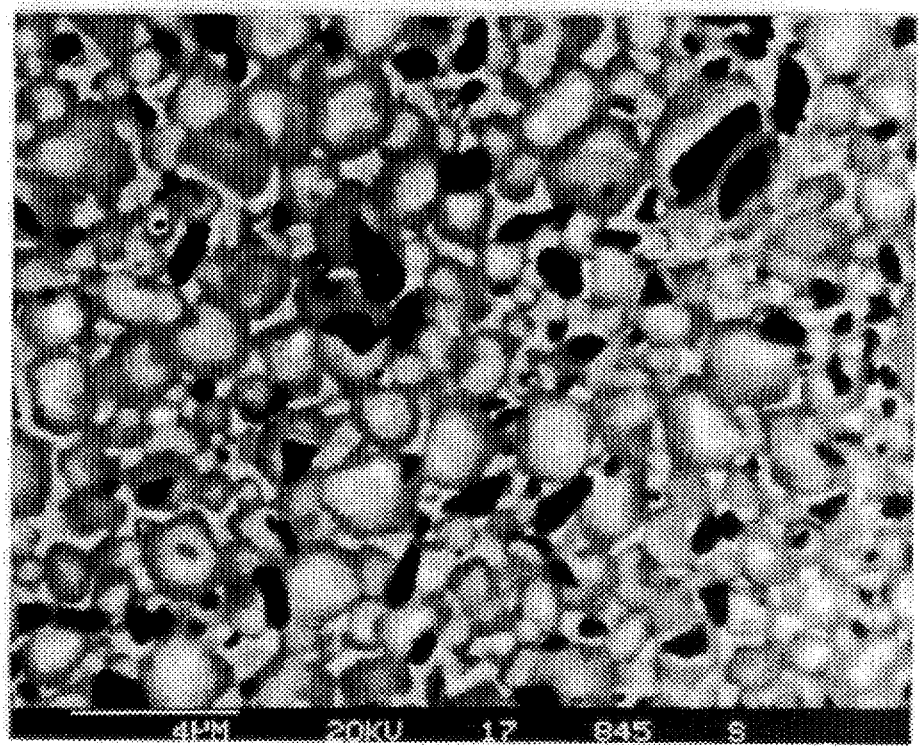
FIG. 1*a, b* each show a scanning electron microscope structure photo of a cermet, made of Ti(C,N), (Ti, W)(Ti,W,Ta; Nb)C, Ni and Co powder (enlargement of 3000:1 (FIG. 1*b*) and 5000:1 (FIG. 1*a*)). alloy A, FIG. 2*a, b* show a scanning electron microscope structure photo of a material, made of TiN, TiC, WC, (Ta,Nb)C, Ni and Co powder (enlargement 3000:1 (FIG. 2*b*) and 5000:1 (FIG. 2*a*)), alloy B, FIG. 3*a, b* show a scanning electron microscope structure photo of the compositions of the invention in the previously described embodiment in an enlargement of 3000:1 (FIG. 3*b*) and 5000:1 (FIG. 3*a*), alloy C.
Figure 1B:
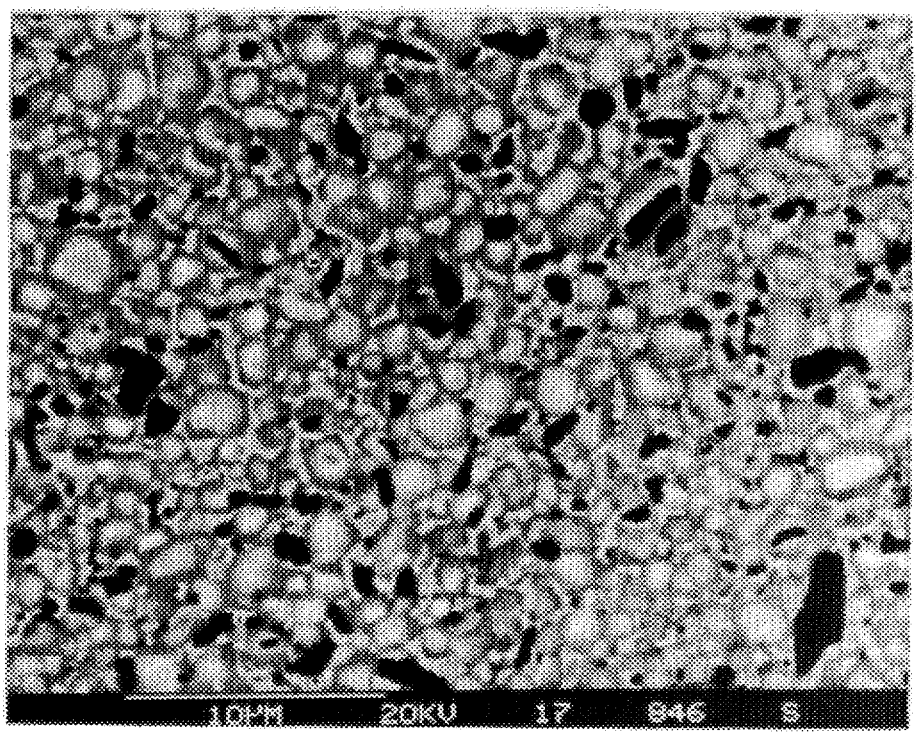
Figure 2A:
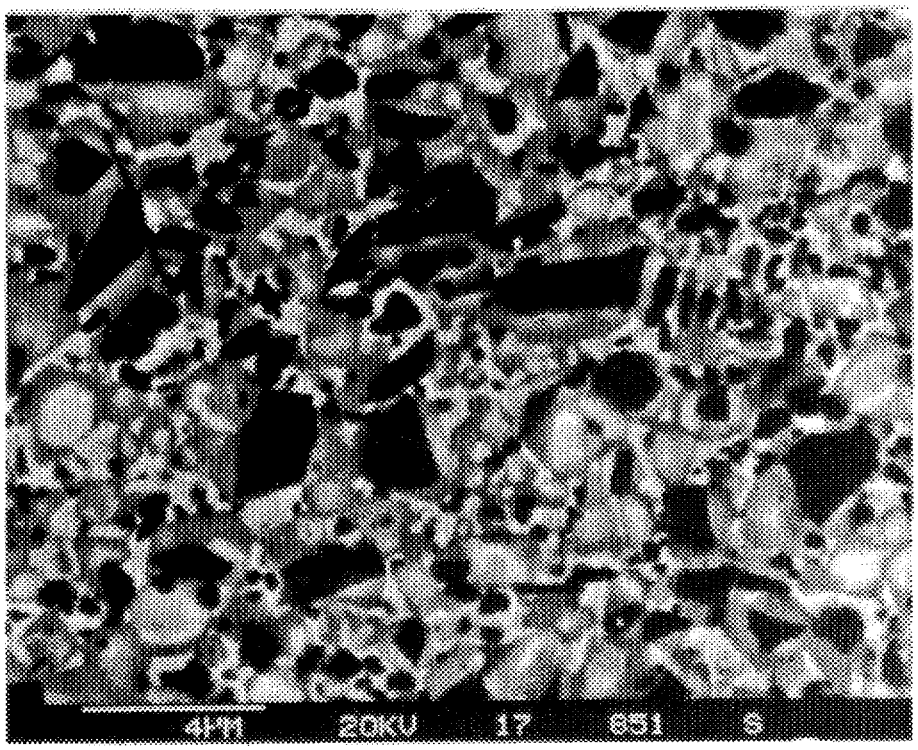
Figure 2B:
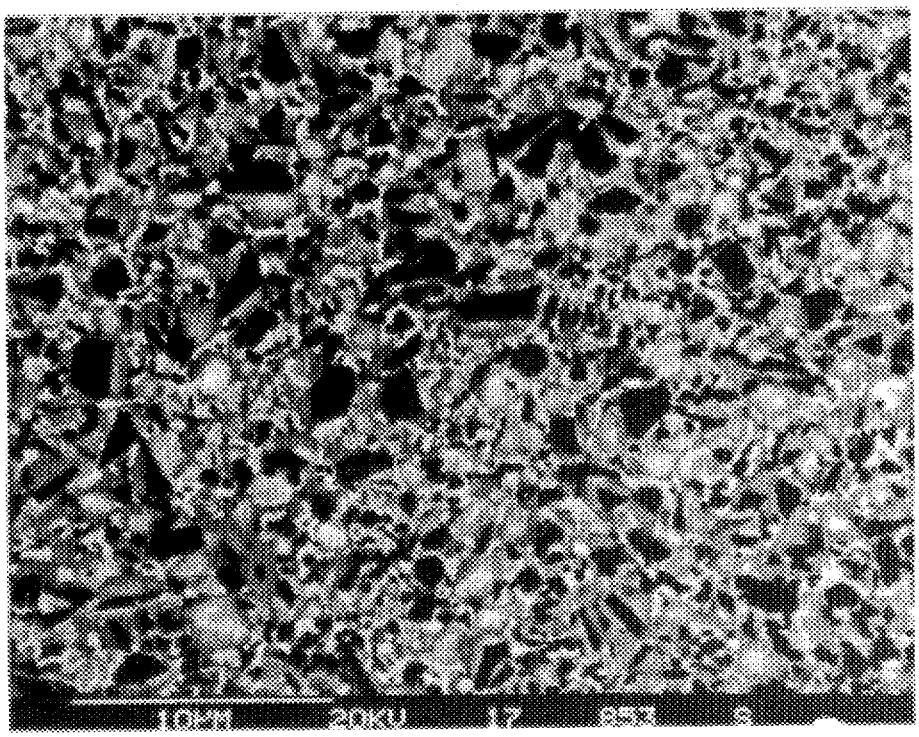
Figure 3A:
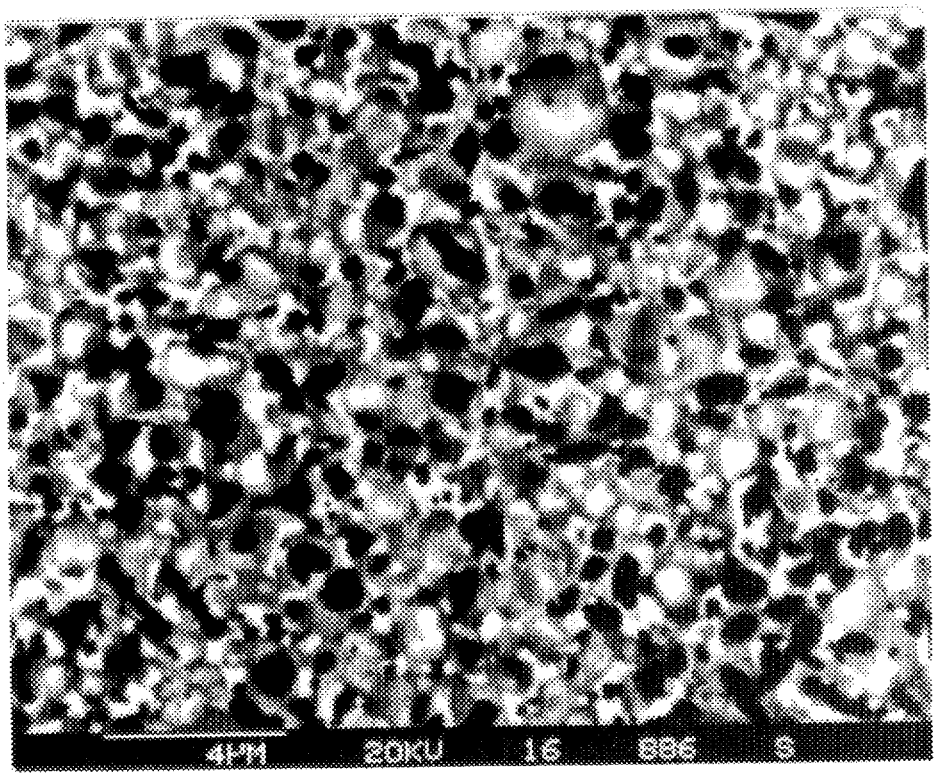
Figure 3B:
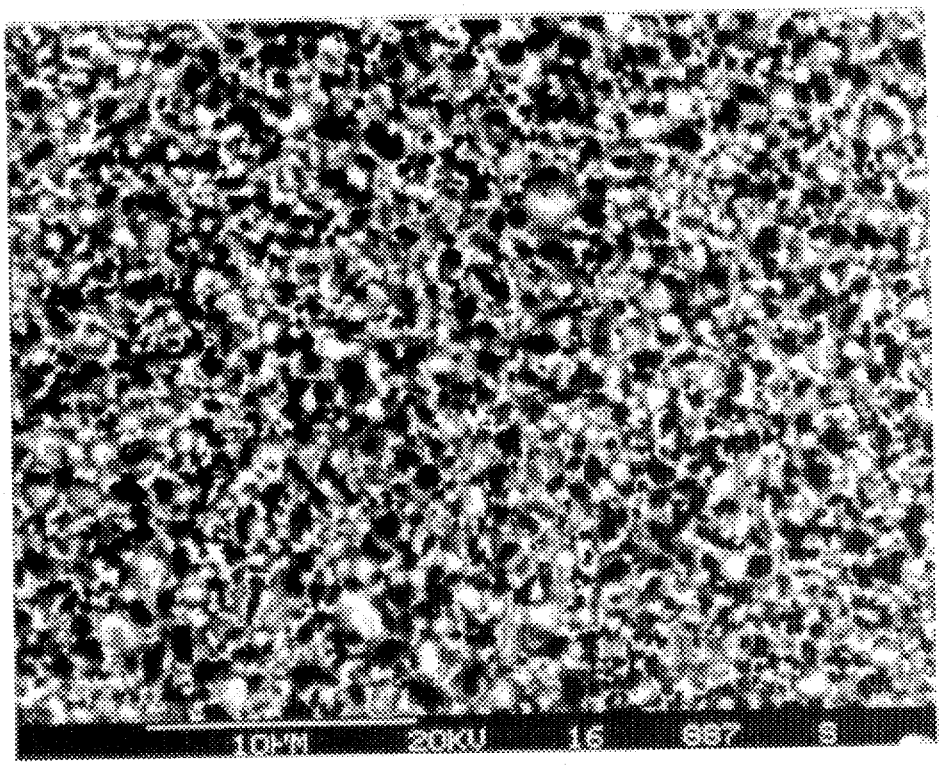

Any comparison of FIG. 1*a*, respectively 2*a* with 3*a* or of 1*b*, respectively 2*b* with 3*b* shows that the cermet alloy of the invention is considerably more fine-grained than the alloys known to the state of the art and contains exclusively particles with a dark core, respectively particles with homogeneous composition. In the shown scanning electron microscope photos backscattered electrons are used for producing the image, i.e. dark structure components have a low density and are therefore rich in Ti, light gray structure components have a higher density and are therefore rich in W and Ta. The binder phase appears almost white.

The cermet alloy C of the invention is used as material for a cutting insert of the geometry SPGN 120308 with a cutting edge chamfer between 30 to 50μ and was compared with indexable inserts of the same geometry made of alloys A and B. The results can be seen from the following data 1. Slotted shaft Workpiece material: CK45N, Strength: 700 N/mm²

| Cutting conditions: | $v_c$ = 250 m/min<br>$a_p$ = 1.5 mm<br>f = 0.2 mm<br>Number of impacts |
|---|---|
| Comparison cermet (alloy A) | 146 (average value from 3 |
| Comparison cermet (alloy B) | 210 cutting corners) |
| Cermet of the invention (alloy C) | 275 |

2. Bolt turning test with advance increase

Workpiece material: CK45N, Strength: 720 N/mm²

| Cutting conditions: | $v_c$ = 250 m/min<br>$a_p$ = 2.0 mm |
|---|---|
| Advance range | 0.10–0.12–0.16–0.20–0.25–0.31 per advance step, 3 overruns<br>Number of overruns |
| Comparison cermet (alloy A) | 7.8 (average value from 3 |
| Comparison cermet (alloy B) | 7.7 cutting corners) |
| Cermet of the invention (alloy C) | 9.5 |

What is claimed is:

1. Cermet with a hard material phase containing (Ti,W, Ta/Nb)C and (Ti,W,Ta/Nb)CN, the balance a binder phase with a proportion of >5% by mass of Co and/or Ni, characterized by a gross composition of 30 to 60% by mass Ti, 5 to 20% by mass W, 5 to 11% by mass Ta which can be replaced up to 70% by Nb, 5 to 25% by mass Ni and/or Co, with more than 80% mole—relative to the abovementioned Ti, W, Ta, and/or Nb, of carbon and nitrogen, which has been prepared from a solid powdery starting mixture with 15 to 45% by mass(Ti,W,Ta)C and/or (Ti,W,Ta,Nb)C, 3 to 15% by mass WC, 5 to 25% by mass Co and/or Ni, the balance Ti(C,N), each with a particle size <1.5μ through grinding, pressing and sintering and which has at least 40% of hard material particles in the structure with a core-margin structure with cores of Ti(C,N), N>C and homogeneous marginal zones of (Ti,W,Ta/Nb)C, whereby the proportion of the hard material phase amounts to 95 to 75% by mass.

2. Cermet according to claim 1, characterized in that the Ti(C,N) is contained in the starting mixture in 25 to 65% by mass.

3. Cermet according to claim 1, characterized in that 40 to 60% by volume of the hard material phase consists of particles with core-margin stucture with a nitrogen-rich core of TiCN with N/(N+C)≦0.7 and a marginal zone of (Ti,W,Ta)C with Ti=50 to 65% by mass, W=15 to 30% by mass, Ta=8 to 20% by mass and that 60 to 40% by volume of the hard material phase consists of particles with a homogeneous composition corresponding to the previously described marginal zone, whereby in the hard material phases up to 70% of the Ta can be replaced by Nb.

4. Cermet according to claim 3, characterized in that on account of the particles with homogeneous composition in addition up to 5% by volume of the hard material particles have a core composition of (Ti,W,Ta,Nb)C with 43 to 53% by mass titanium, 35 to 50% by mass tungsten, 4 to 8% by mass tantalum and/or niobium.

5. Cermet according to claim 1, characterized in that the hard material phase has exclusively a cubic $B_1$-crystalline structure and an average core diameter <1.5μ with an even distribution of the binder metal phase.

6. Cermet according to claim 1, characterized in that additionally 0 to 12 Mo, 0 to 5 V, 0 to 2 Cr and/or 0 to 2 Al are contained in % by mass.

7. Cermet according to claim 1, characterized in that the binder is present in a proportion of Ni/(Ni+Co)=0.2 to 0.8.

8. Cermet according to claim 1, characterized in that in the binder metal phase there are larger amount of tungsten than of titanium.

9. Cermet according to claim 6, characterized in that the amount of dissolved molybdenum, vanadium, chrome and tungsten is larger than the amount of titanium.

10. Cermet according to claim 1, characterized in that the nitrogen proportion in relation to the sum of carbon and nitrogen ranges between 0.2 and 0.8.

11. A process for producing a cermet with a hard material phase containing (Ti,W,Ta/Nb)C, (Ti,W,Ta/Nb)CN, the balance a binder phase with a proportion of >5% by mass of Co and/or Ni, said cermet having a gross composition of 30 to 60% by mass Ti, 5 to 20% by mass W, 5 to 11% by mass Ta which can be replaced up to 70% by Nb, 5 to 25% by mass Ni and/or Co, with more than 80% mole relative to the abovementioned Ti, W, Ta, and/or Nb of carbon and nitrogen, and which has at least 40% of hard material particles in the structure with a core-margin structure with cores of Ti(C,N) N>C and homogeneous marginal zones of (Ti,W,Ta/Nb)C, whereby the proportion of the hard material phase amounts to 95 to 75% by mass, which comprises the steps of:

(1) grinding a starting mixture which contains the following components:

(a) 15 to 45% by mass (Ti,W,Ta)C with an average particle size of <1.5 μm, whereby this carbide mixture contains 20 to 50% by mass TiC, 20 to 40% by mass WC, and 20 to 40% by mass TaC, whereby the Ta can be replaced up to 70% by mass by Nb;

(b) 3 to 15% by mass WC with an average particle size of <1.5 μm;

(c) 5 to 25% by mass nickel and/or cobalt; and (d) the balance Ti(C,N) with an average particle size of <1.5 μm and a proportion of N/(C+N)>0.7, to obtain a ground mixture;

(2) pressing the ground mixture obtained during step (a) into a green compact; and (3) sintering the green compact to obtain the cermet.

12. Process according to claim 11, characterized in that the starting powder mixture contains 25 to 65% by mass of Ti(C,N).

13. Process according to claim 11, characterized in that the starting powder mixture contains additionally up to 5% by mass of at least one of the components $TiAl_2$ C, Mo, $Mo_2C$, Cr, $Cr_2C_3$ and V.

14. Process according to claim 11, characterized in that the carbide mixture (W,Ti,Ta)C or (W,Ti, Ta,Nb)C is present in an average fine-graininess of 0.5μ in the proportion of the carbides WC:TiC:TaC: or (Ta,Nb)C=1:1:1.

15. Process according to claim 11, characterized in that the Ti(C,N) is present in an average particle size of 1.2μ with a proportion of N/(C+N)=0.75.

* * * * *